US006342681B1

(12) United States Patent
Goldberger et al.

(10) Patent No.: US 6,342,681 B1
(45) **Date of Patent: *Jan. 29, 2002**

(54) SURFACE MOUNT COUPLER DEVICE

(75) Inventors: Haim Goldberger; Isaac Refaely, both of Modi'in; Ehud Elron, Jerusalem, all of (IL)

(73) Assignee: AVX Corporation, Myrtle Beach, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/950,844

(22) Filed: Oct. 15, 1997

(51) Int. Cl.[7] ..... H01R 9/09

(52) U.S. Cl. ..... 174/261; 174/250; 333/116; 333/248

(58) Field of Search ..... 174/261, 250; 333/116, 238, 247; 361/748; 336/192

(56) References Cited

U.S. PATENT DOCUMENTS

| | | | | |
|---|---|---|---|---|
| 3,729,814 | A | | 5/1973 | Wright et al. |
| 3,785,046 | A | | 1/1974 | Jennings |
| 4,020,222 | A | | 4/1977 | Kausche et al. |
| 4,038,167 | A | | 7/1977 | Young |
| 4,222,816 | A | * | 9/1980 | Noble, Jr. et al. |
| 4,283,485 | A | * | 8/1981 | Muenz et al. |
| 4,376,274 | A | * | 3/1983 | Smart |
| 4,451,554 | A | * | 5/1984 | Kishi et al. |
| 4,476,216 | A | * | 10/1984 | Tobias |
| 4,481,283 | A | * | 11/1984 | Kerr et al. |
| 4,607,240 | A | * | 8/1986 | Isota et al. ..... 333/116 |
| 4,612,083 | A | * | 9/1986 | Yasumoto et al. |
| 4,613,843 | A | * | 9/1986 | Esper et al. |
| 4,678,542 | A | * | 7/1987 | Boer et al. |
| 4,814,289 | A | * | 3/1989 | Baeuerle |
| 4,987,099 | A | * | 1/1991 | Flanner |
| 5,061,651 | A | * | 10/1991 | Ino |
| 5,063,177 | A | | 11/1991 | Geller et al. |
| 5,120,572 | A | | 6/1992 | Kumar |
| 5,166,037 | A | | 11/1992 | Atkinson et al. |
| 5,355,014 | A | | 10/1994 | Rao et al. |
| 5,363,080 | A | * | 11/1994 | Breen ..... 336/192 |
| 5,363,081 | A | | 11/1994 | Bando et al. |
| 5,369,379 | A | | 11/1994 | Fujiki |
| 5,370,766 | A | | 12/1994 | Desaigoudar et al. |
| 5,432,116 | A | | 7/1995 | Keum et al. |
| 5,447,881 | A | | 9/1995 | Ryou |
| 5,450,263 | A | | 9/1995 | Desaigoudar et al. |
| 5,534,830 | A | | 7/1996 | Ralph |
| 5,841,328 | A | | 11/1998 | Hayashi |

FOREIGN PATENT DOCUMENTS

| | | | |
|---|---|---|---|
| JP | 59-169203 | 9/1984 | |
| JP | 60-247304 | 12/1985 | |
| JP | 3-295302 | * 12/1991 | ..... 333/116 |

(List continued on next page.)

*Primary Examiner*—Albert W. Paladini
(74) *Attorney, Agent, or Firm*—Dority & Manning, P.A.

(57) ABSTRACT

A surface mount coupler device is provided having a device body with a plurality of terminations located thereon. The coupler device is particularly useful in high frequency circuits to provide coupling between two circuit lines without direct electrical contact. For example, the device may provide coupling between a feedback control loop and an amplifier output section in a RF transmitter. The device body is built up on a rigid insulative substrate. During manufacture, one or more layers of insulative polymer are applied to the insulative substrate. The insulative polymer defines conductor channels in which primary and secondary conductors are located. The primary and secondary conductors are electrically connected to a respective pair of the terminations located on the device body. A sealing cover, preferably glass, is located above the polymeric insulative layers.

16 Claims, 8 Drawing Sheets

FOREIGN PATENT DOCUMENTS

| | | | |
|---|---|---|---|
| JP | 5-3406 | * | 1/1993 |
| JP | 5152814 A | | 6/1993 |
| JP | 66118 | | 1/1994 |
| JP | 645811 | * | 2/1994 |
| JP | 8-191206 | * | 7/1996 |
| JP | 8-307117 | * | 11/1996 |
| JP | 9-116312 | * | 5/1997 |

* cited by examiner

SURFACE MOUNT COUPLER DEVICE

BACKGROUND OF THE INVENTION

The present invention relates generally to small electronic components adapted to be surface mounted on a larger circuit board. More particularly, the invention relates to a surface mount coupler device for use in a variety of applications.

Surface mount components are often rectangular, and very small. For example, the component may have length and width dimensions of less than 1/10 of an inch. Generally speaking, the component body will include side terminations compatible with mass production soldering techniques.

In various types of electronic equipment, it is often necessary to sample the electrical activity in certain conductor lines. For example, electrical activity in the line of interest may be subject to feedback control. Typical coupler devices utilized for this purpose allow sampling without direct galvanic connection. A need exists, however, for novel coupler devices that are compatible with surface mount techniques.

SUMMARY OF THE INVENTION

The present invention recognizes various disadvantages of prior art constructions and methods. Accordingly, it is an object of the present invention to provide novel surface mount components.

It is a more particular object of the present invention to provide various novel structures for a surface mount coupler device.

It is a further object of the present invention to provide small coupler devices particularly adapted for use in RF applications.

It is also an object of the present invention to provide novel methodology for the production of a coupler device.

Some of these objects are achieved by a surface mount coupler device comprising a device body having four electrical terminations located thereon. The device body includes an insulating substrate having a top surface and a bottom surface. A first insulative layer, defining first and second conductor channels therein, is disposed on the top surface of the substrate. First and second conductors are located in the respective first and second conductor channels. The first conductor is electrically connected to first and second terminations on the device body. The second is electrically connected to at least a third termination on the device body. An insulative cover layer disposed above the first insulative layer.

In some exemplary embodiments, the second conductor is electrically connected to third and fourth terminations on the device body. The device body may also have at least six terminations thereon, with the first insulative layer further defining a third conductor channel. In this case, a conductor located in the third conductor channel is electrically connected to fifth and sixth terminations on the device body.

The respective conductors preferably include respective first and second elongate portions situated in parallel to one another and separated by a predetermined spacing. For example, the first and second elongate portions are substantially straight. Alternatively, the first and second elongate portions may be V-shaped.

The four terminations may be located on sides of the device body. For example, the device body may define opposed side faces and opposed end faces. In this case, two of the four terminations may be located on each of the opposed side faces.

The coupler device may be configured as a multiple insulative layer structure having a second insulative layer disposed on top of the first insulative layer. For example, a third conductor located directly above the first insulative layer. Preferably, the third conductor is electrically connected to one of the first conductor or the second conductor. Often, the third conductor may be electricly connected to a fourth termination on the device body.

Furthermore, at least one of the conductor channels defined in the first insulative layer may be discontinuous to define at least one crossing bridge for the third conductor. In such cases, a thin conductive element preferably extends under the crossing bridge.

In multiple insulative layer embodiments, the first conductor may be U-shaped. In addition, the second conductor and third conductor may be configured to form a spiral.

Other objects of the present invention are achieved by a surface mount coupler device comprising a device body having four electrical terminations located thereon. The device body includes an insulating substrate having a top surface and a bottom surface. A first insulative layer, defining a first conductor channel therein, is disposed on the top surface of the substrate. A first conductor, electrically connected to first and second terminations on the device body, is situated in the first conductor channel.

The device body further comprises a second insulative layer disposed on top of the first insulative layer. The second insulative layer defines a third conductor channel having a second conductor therein. The second conductor is electrically connected to at least a third termination on the device body. An insulative cover layer is disposed above said third insulative layer.

In exemplary embodiments, the insulative layers are constructed of an insulative polymeric material. For example, the insulative polymeric material may be a photoimagable polyimide. The respective conductors may be formed as multilayer planar conductors, such as by electroplating to an initial layer.

Other objects, features and aspects of the present invention are provided by various combinations and subcombinations of the disclosed elements, as well as methods of practicing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
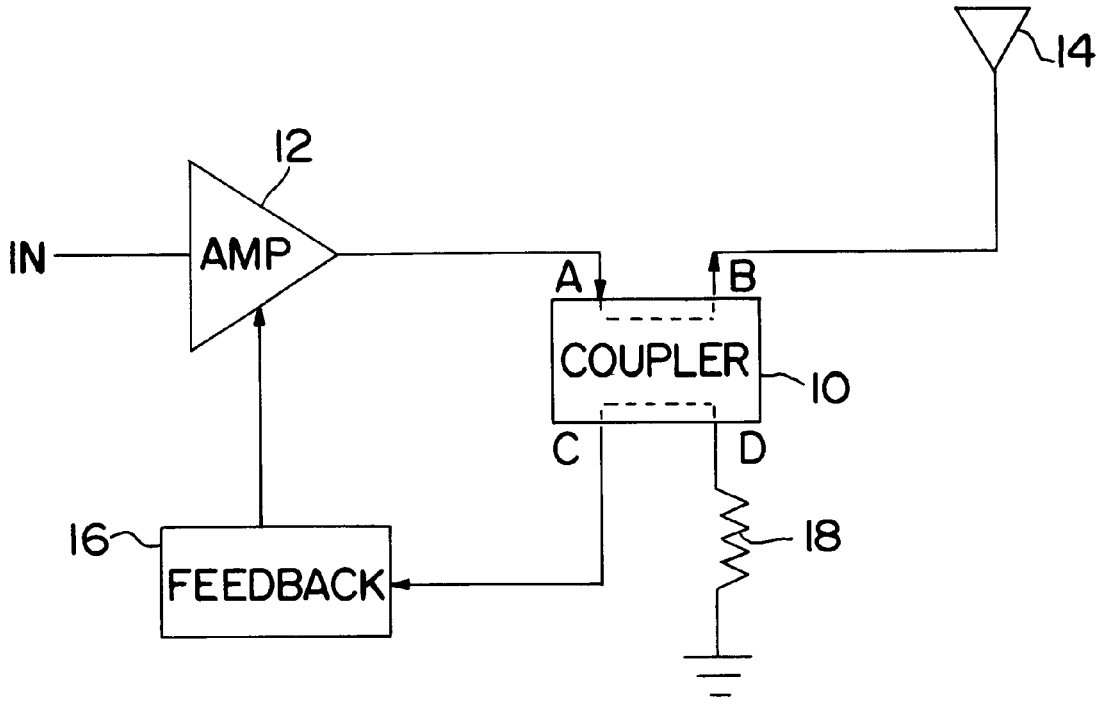
FIG. 1 is a diagrammatic representation showing a typical application in which a coupler device of the present invention may be utilized.

Repeat use of reference characters in the present specification and drawings is intended to represent same or analogous features or elements of the invention.

DETAILED DESCRIPTION OF PREFERRED EMBODIMENTS

It is to be understood by one of skill in the art that the present discussion is a description of exemplary embodiments only, and is not intended as limiting the broader aspects of the present invention, which broader aspects are embodied in the exemplary constructions.

FIG. 1 diagrammatically illustrates a coupler 10 of the present invention employed in a typical application. In this case, coupler 10 is installed in the output section of an RF device, such as a cellular telephone. The output section includes a power amplifier 12 operative to amplify the RF signal received at its input to an appropriate level for transmission via antenna 14.

As can be seen, device 10 has four terminations respectively designated A, B, C and D. Terminations A and B are serially connected into the main line between amplifier 12 and antenna 14, as shown. Terminations C and D are similarly connected into a feedback loop including a predetermined compensator 16. Typically, a resistor 18 will be connected between termination D and ground. In many applications, resistor 18 may have a value of about fifty ohms.

Due to principles of electromagnetic induction, coupler 10 provides operative coupling between the output of amplifier 12 and the feedback loop. The output of amplifier 12 can be monitored in this manner, and adjusted as desired. For example, it may be desirable to ensure that amplifier 12 delivers a constant level of output power. Alternatively, output power can be selectively varied, such as in proportion to a received signal.

Figure 2:
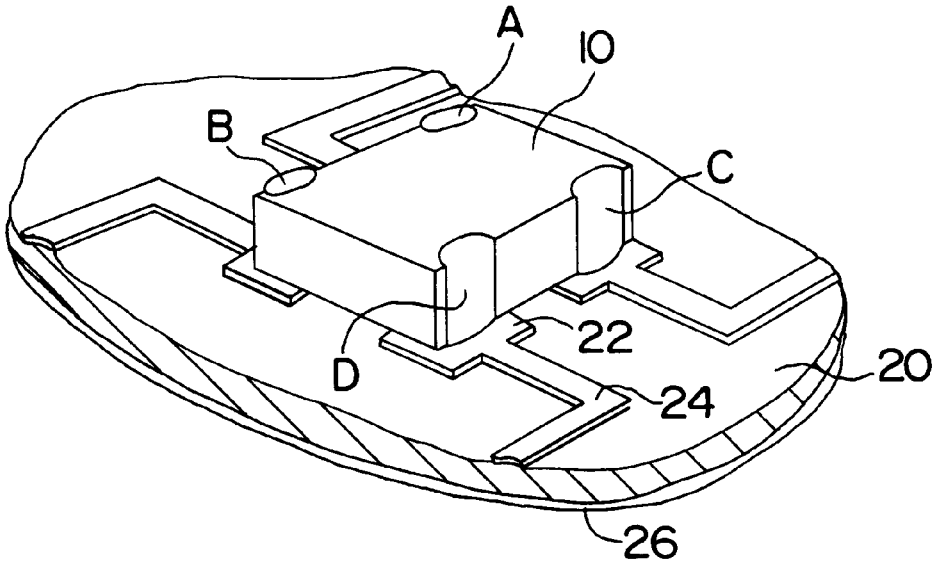
FIG. 2 is a perspective view of a coupler device constructed in accordance with the present invention in position on a printed circuit board.

Referring now to FIG. 2, coupler 10 is shown as it may appear when surface mounted to a printed circuit board 20. As shown, terminations A, B, C, and D are attached to the board at respective mounting pad, such as pad 22. Conductive traces, such as trace 24, are defined on the top surface of circuit 20 extending from each of the mounting pads. The conductive traces thus provide electrical communication between the respective terminations and the remainder of the circuit into which coupler 10 is connected.

In the illustrated example, circuit board 20 includes a conductive ground plane 25 defined on its bottom surface. Circuit board 20 may be made from a low-temperature organic material, with the solder often being a low temperature eutectic solder applied by wave, reflow, vapor phase or manual soldering techniques.

Figure 3:
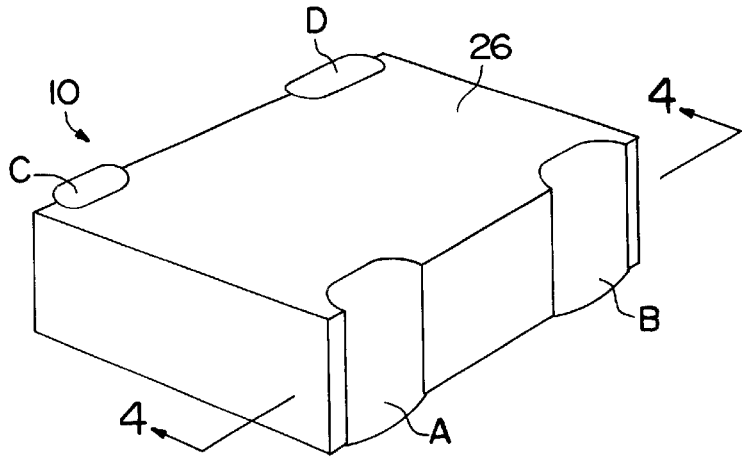
FIG. 3 is an enlarged view from a perspective opposite that of FIG. 2 with the coupler device removed from the circuit board.
Figure 4:
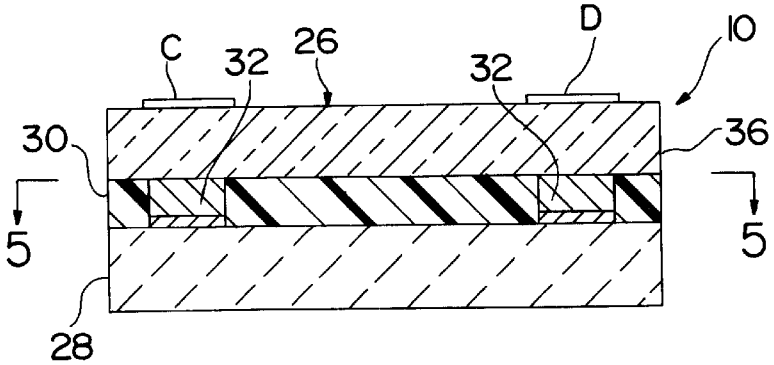
FIG. 4 is a cross-sectional view as taken along line 4—4 of FIG. 3.
Figure 5:
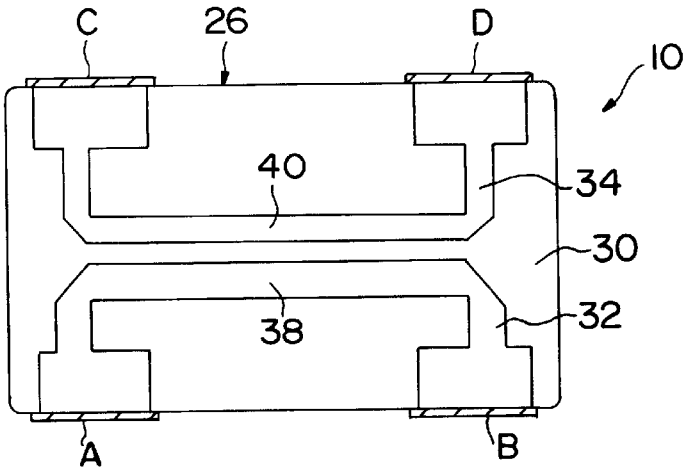
FIG. 5 is a cross-sectional view taken along line 5—5 of FIG. 4.

Referring now to FIGS. 3–5, a preferred construction of coupler 10 will be explained. In this case, coupler 10 has a rectangular device body 26 defining a longer length dimension and a shorter width dimension. Preferably, device body 26 is sized to conform to a standard size for other small surface mount components, such as multilayer ceramic capacitors. According to industry practice, the size of a such a component is generally expressed as a number "XXYY," with XX and YY being the length and width, respectively, in hundredths of an inch. A typical size under this practice is 0805.

Device body 26 includes a substrate 28 of alumina or similar rigid insulative material. For example, substrate 28 may be made from a glazed alumina. A first insulative layer 30, disposed above substrate 28, defines therein a pair of conductor channels. A main line, or primary, conductor 32 fills one of the conductor channels, and extends between terminations A and B. Similarly, a secondary conductor 34 fills the other conductor channel, and extends between terminations C and D. A sealing cover 36, which may be formed of glass, glass-ceramic, alumina or a similar rigid insulative material, is located above insulative layer 30.

As can be seen most clearly in FIG. 5, conductors 32 and 34 include respective elongate portions 38 and 40 that extend substantially in parallel with one another. The close proximity of elongate portions 38 and 40 provide the desired electromagnetic coupling. For example, elongate portions 38 and 40 may be spaced apart by about 1.7 mils in a preferred embodiment.

It will be appreciated that a number of factors will affect the degree of coupling, including the spacing and length of elongate portions 38 and 40, and the specific materials utilized in the manufacture of coupler 10. In this case, conductor 32 has a width greater than conductor 34 since it will be required to accommodate greater flow of current. For example, conductor 32 may have a width of about 5 mils, with conductor 34 having a width of about 3 mils in a preferred embodiment.

During manufacture of coupler 10, substrate 28 is appropriately cleaned. A thin layer of metal, such as CrCu, is then deposited over the entire top surface of substrate 28. The thin metal layer is next etched and stripped by photolithographic techniques to the configuration of conductors 32 and 34. A photoimagable polyimide is next applied over the substrate to a thickness preferably exceeding 15 microns, and most preferably to a thickness of about 25 microns.

The polyimide layer is masked and exposed to UV light and rinsed to define the conductor channels in registry with the metal conductor patterns. The exposed metal is then electroplated, preferably to an overall conductor height of about 25 microns. Various metals may be electroplated in this manner, including copper, silver, gold and the like. Sealing cover 36 is next applied over the surface of the polyimide layer.

Often, coupler 10 will be one of many manufactured in a larger sheet. After the larger sheet is diced, terminations A-D are applied according to known techniques. It will be appreciated that, in many respects, the manufacture of coupler 10 is made according to the techniques described in U.S. Pat. No. 5,363,080 to Breen, incorporated herein by reference.

Figure 6A:
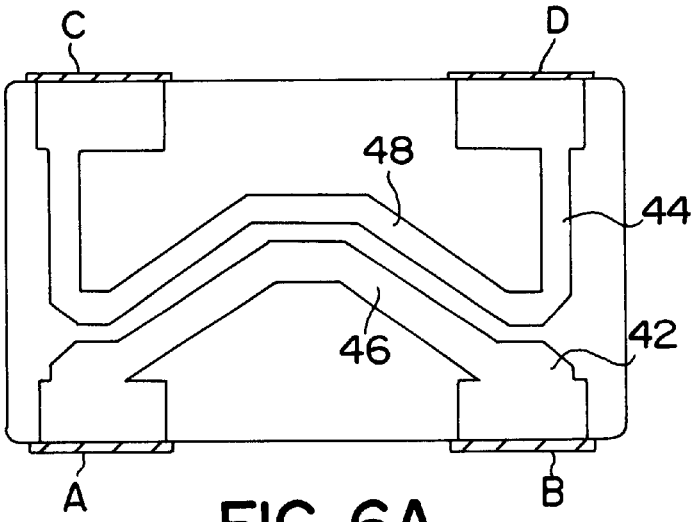
FIGS. 6A and 6B are views similar to FIG. 5 showing alternative conductor patterns.
Figure 6B:
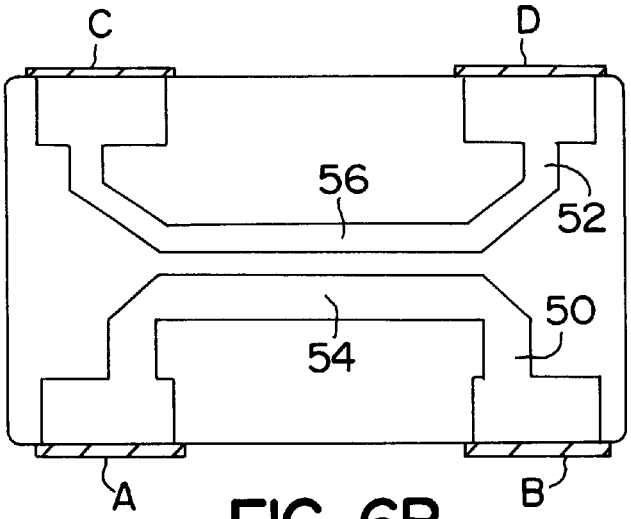

FIGS. 6A and 6B illustrate alternative conductor patterns for a coupler device generally as described above. In the embodiment of FIG. 6A, first conductor 42 and second conductor 44 define respective V-shaped elongate portions 46 and 48. In FIG. 6B, primary conductor 50 and secondary conductor 52 define shorter elongate portions 54 and 56. The longer parallel length achieved in the embodiment of FIG. 6A generally provides an enhanced coupling factor.

Figure 7:
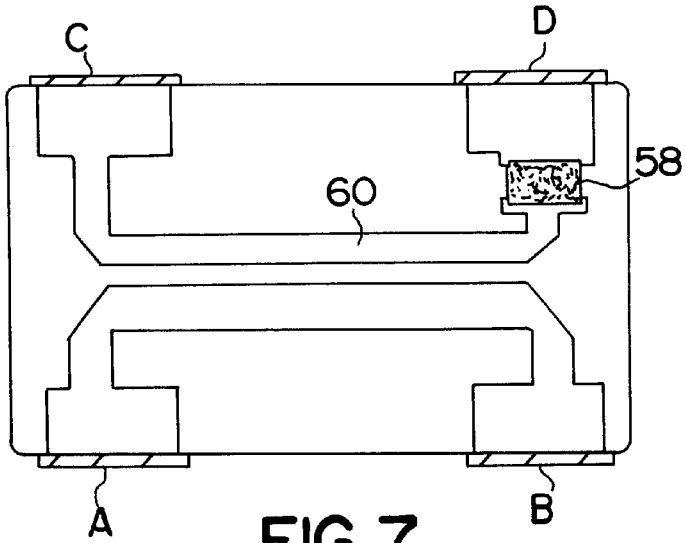
FIG. 7 is a view similar to FIG. 5 wherein one of the conductor patterns includes a serial resistor.
Figure 8:
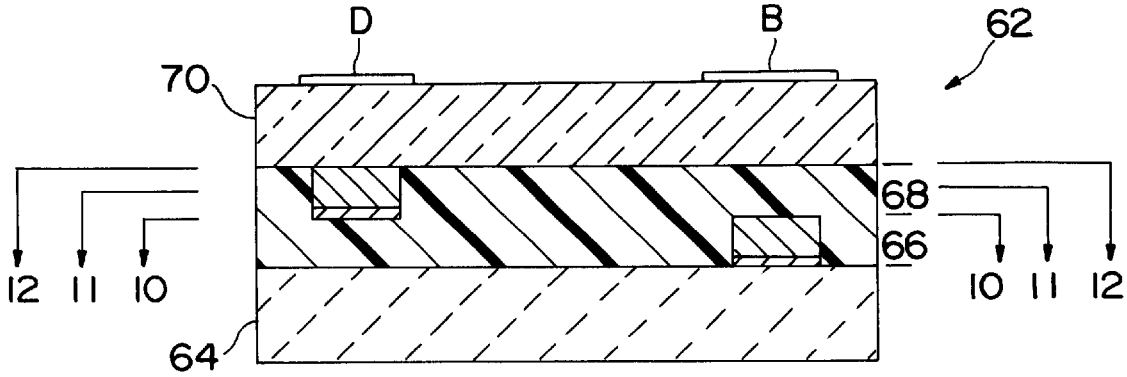
FIG. 8 is a cross-sectional view along a similar plane as the view of FIG. 4 of an alternative structure with conductor patterns on multiple layers.

A still further alternative is illustrated in FIG. 7. In this case, a resistive element 58 is located in series with secondary conductor 60. Resistive element 58 advantageously eliminates the need for providing a separate resistor 18 (FIG. 1) in electrical communication with termination D. Termination D can thus be directly connected to ground. It will be appreciated that any of the various coupler configurations described herein can be equipped with a similar internal resistor.

In the embodiments discussed above, the respective conductors are located in a common plane on top of the rigid substrate. According to other embodiments of the invention, at least one of the conductors may partially or wholly be located on a plane above the other conductor with which it will couple. Such embodiments have the advantage of permitting even longer parallel portions of each conductor, with the coupling factor thereby increased.

Referring now to FIGS. 8–12, one such coupler 62 is illustrated. Like coupler 10, coupler 62 includes a substrate 64 of alumina or similar rigid insulative material. In this case, however, a plurality of polymeric insulative layers are disposed above substrate 64. In particular, coupler 62 includes first insulative layer 66 and second insulative layer 68. It will be appreciated that such a device may be made using photoimagable polyimide by repeating the processing steps described above for each successive layer. A sealing cover 70 is located above second insulative layer 70.

Figure 9:
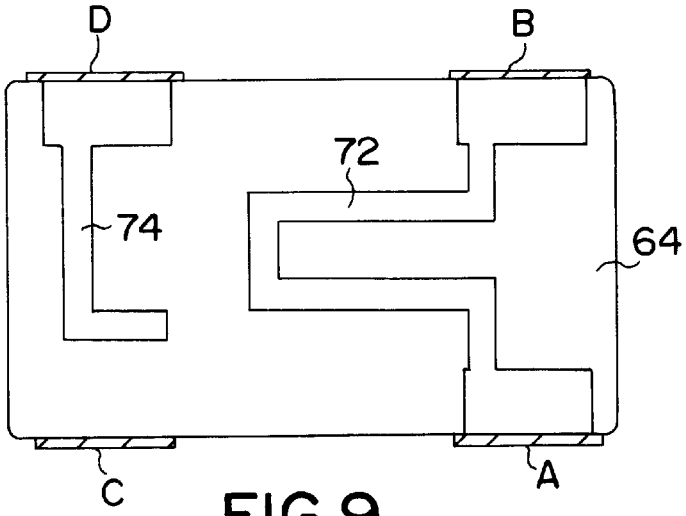
FIG. 9 is a cross-sectional view of the coupler of FIG. 8 as taken along the top surface of the insulating substrate but showing a thin conductive pattern formed thereon.
Figure 10:
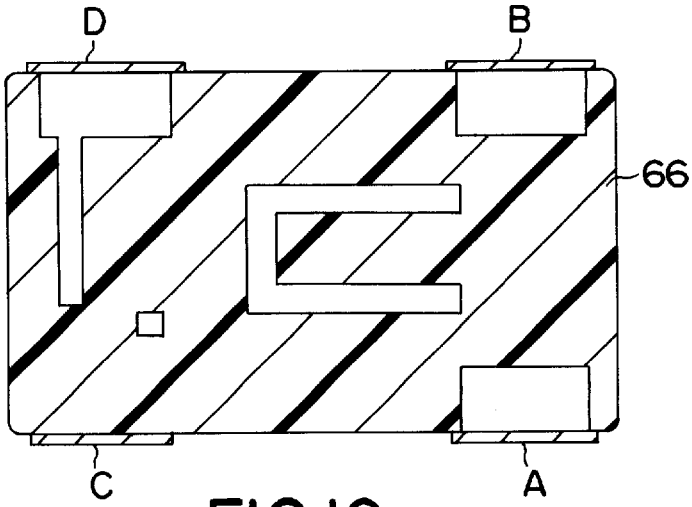
FIG. 10 is a cross-sectional view as taken along line 10—10 of FIG. 8.

As shown in FIG. 9, the thin metallic pattern formed on the top surface of substrate 64 defines the entire outline 72 of the primary conductor as well as a portion 74 of the secondary conductor. As illustrated in FIG. 10, the conductor channels in first insulative layer 66 are generally in register with the thin metallic pattern. It should be noted, however, that discontinuities are formed in the conductor channel at several locations. Despite the discontinuities, the conductors formed within the conductor channels of first insulative layer 66 will remain in electrical communication by virtue of the thin conductor pattern underneath.

Figure 11:
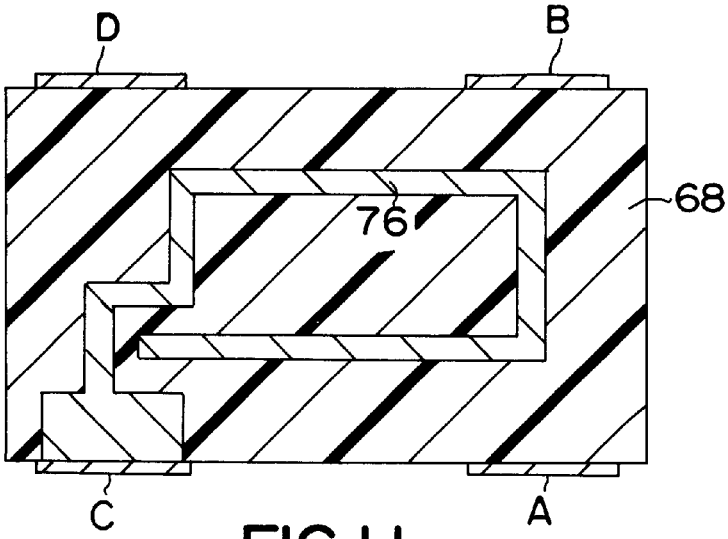
FIG. 11 is a cross-sectional view as taken along line 11—11 of FIG. 8.
Figure 12:
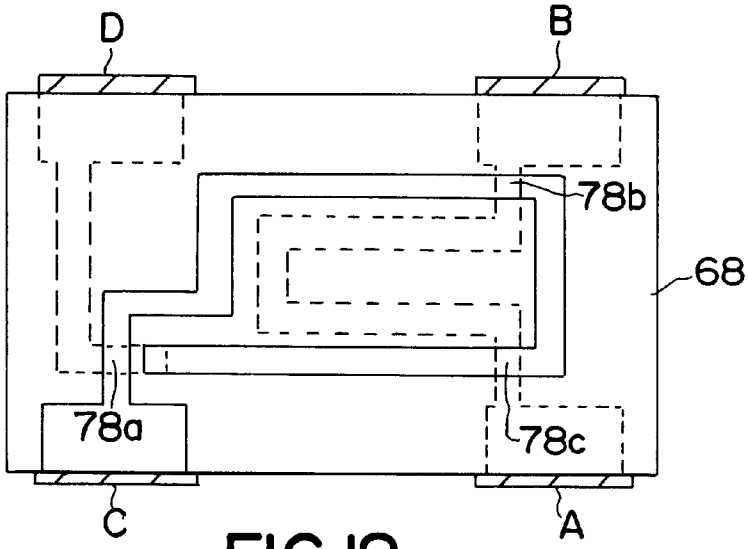
FIG. 12 is a cross sectional view as taken along line 12—12 of FIG. 8 showing lower layer conductors in phantom.

The discontinuities in the conductor channels of insulative layer 68 provide insulated crossing bridges for subsequently formed conductors. As shown in FIG. 11, conductor portion 76 of second insulative layer 68 crosses the conductors of first insulative layer 66 without shorting. The particular crossing locations 78*a*–*c* are most readily seen in FIG. 12.

Figure 13:
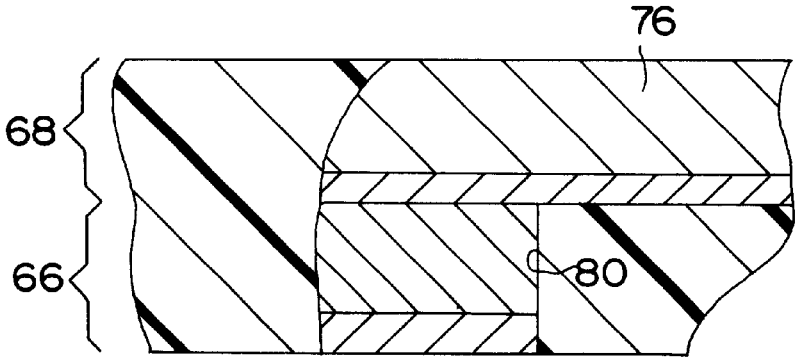
FIG. 13 is an enlarged cross-sectional view showing interconnection between conductors in the various layers in the coupler device of FIG. 8.
Figure 14:
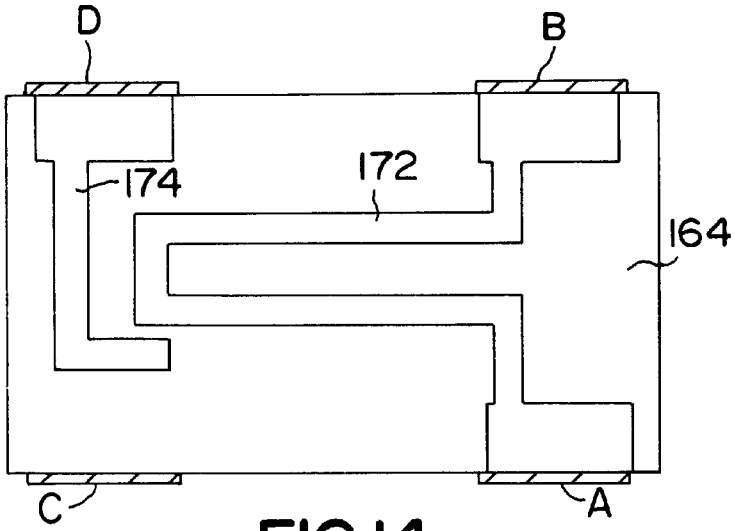
FIGS. 14–17 are cross-sectional views similar to FIGS. 9–12 in a further alternative structure with conductor patterns on multiple layers.
Figure 15:
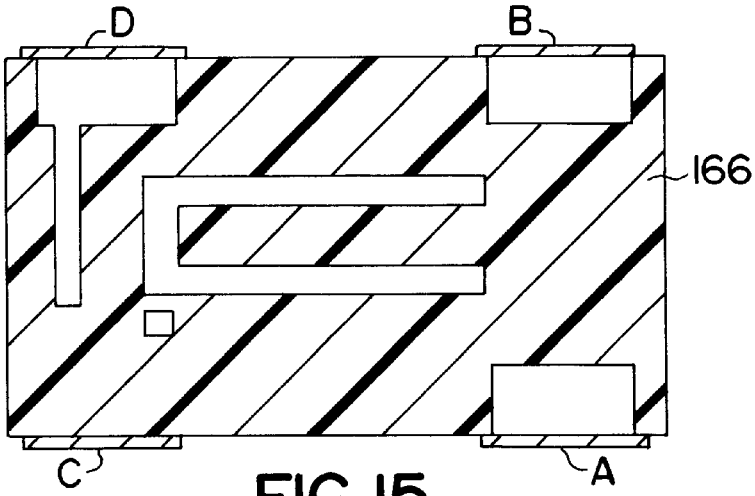
Figure 16:
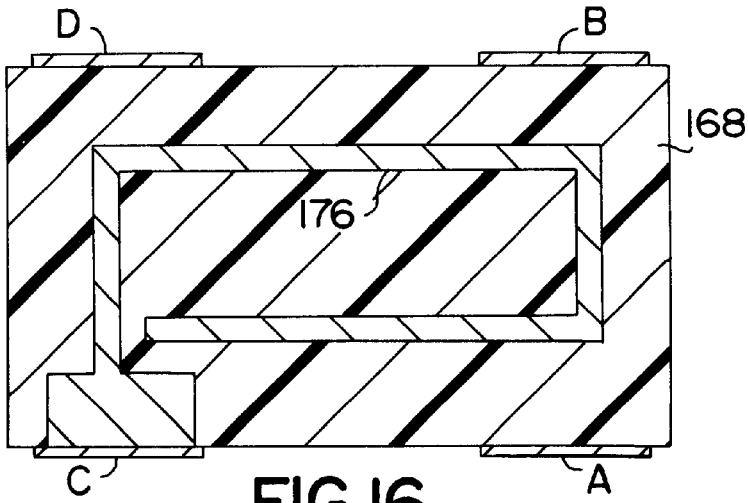
Figure 17:
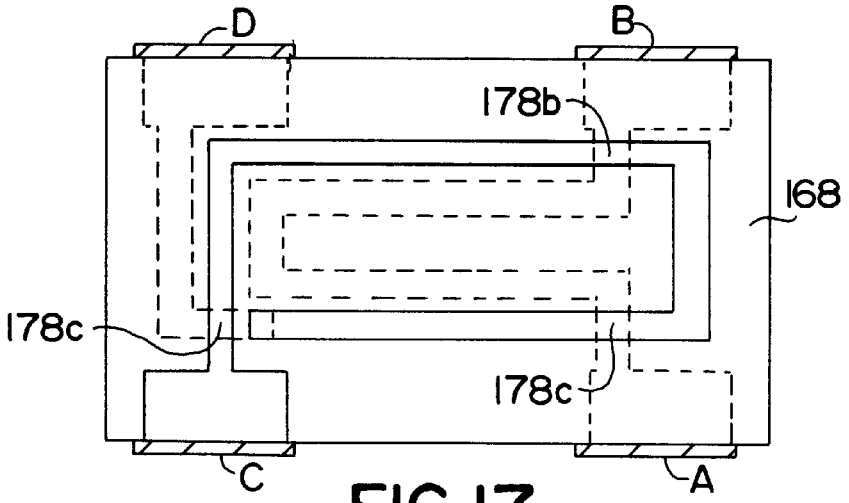

Referring now to FIG. 13, electrical connection between the conductors of insulative layers 66 and 68 is achieved through an aperture 80 defined in insulative layer 66. In particular, second insulative layer 66 defines aperture 80 at a location in registry with an end of the secondary conductor portion formed therein. As a result, electrical connection with conductor portion 76 can be achieved. Because FIG. 13 is enlarged in comparison with previous figures, the multilayer structure of the conductors, due to the electroplating process described above, can be easily seen.

FIGS. 14 through 17 illustrate a further multilayer embodiment that is similar in many respects to the embodiment of FIGS. 9 through 12. This embodiment will not be described in detail since its construction will thus be readily apparent to one skilled in the art. Analogous elements to the embodiment of FIGS. 9 through 12 have reference numbers augmented by one hundred.

Figure 18:
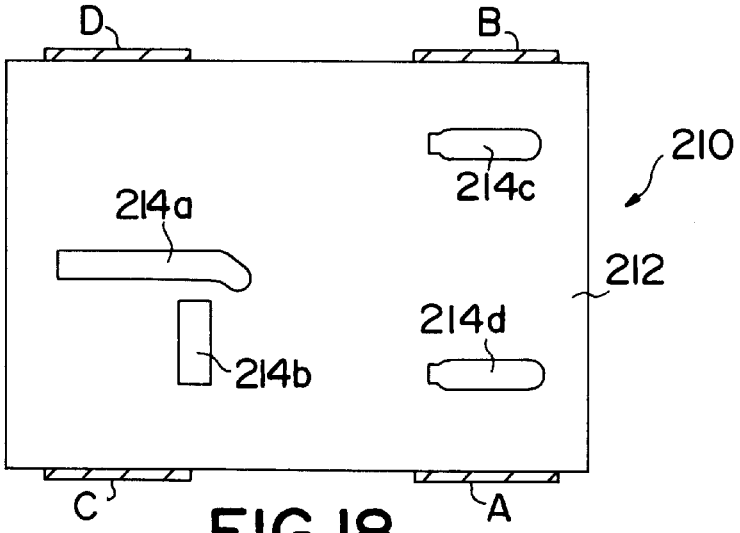
FIGS. 18–21 are cross-sectional views similar to FIGS. 9–12 in a still further alternative structure with conductor patterns on multiple layers.
Figure 19:
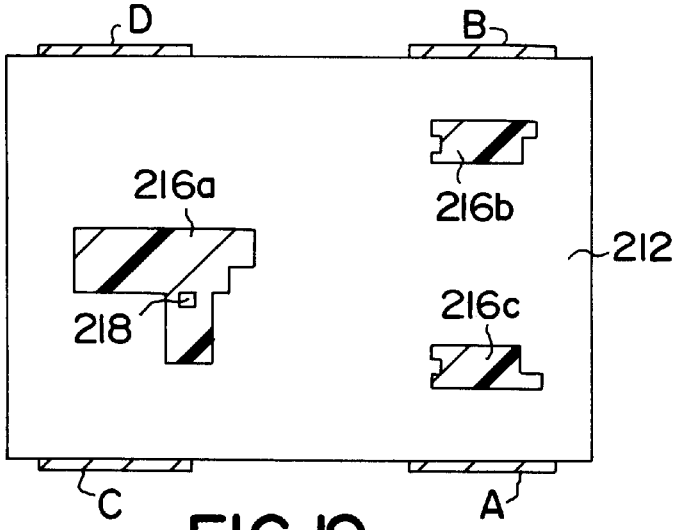

FIGS. 18 through 22 illustrate a coupler device 210 in which a multiturn secondary conductor is predominantly located on the same planar level with the primary conductor. As shown in FIG. 18, the thin metallic pattern defined on insulating substrate 212 forms a plurality of interconnects 214*a*–*d*. Next, as shown in FIG. 19, polymeric insulators 216*a*–*c* are formed over the interconnects. An aperture 218 is formed in insulator 216*a* at a location in registry with an end of interconnect 214*b*.

Figure 20:
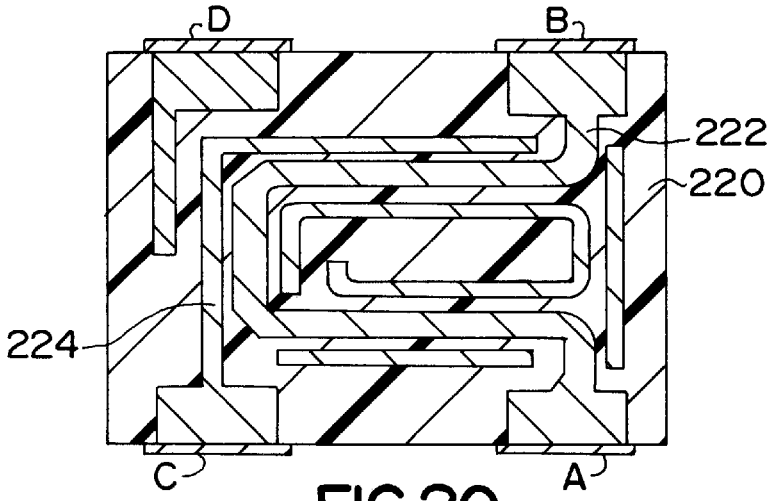
Figure 21:
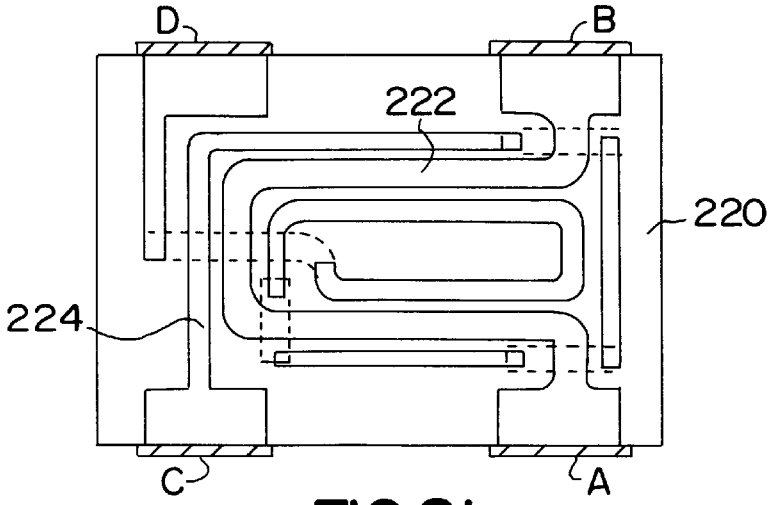

Referring now to FIG. 20, an insulative polymer layer 220 is then formed as described above to define a plurality of conductor channels. As shown, primary conductor 222 extends between terminations A and B. Various secondary line segments are located to be electrically connected by the interconnects defined on substrate 212. The resulting secondary conductor 224 is clearly shown in FIG. 21, and loops both inside and outside of primary conductor 222.

Figure 22:
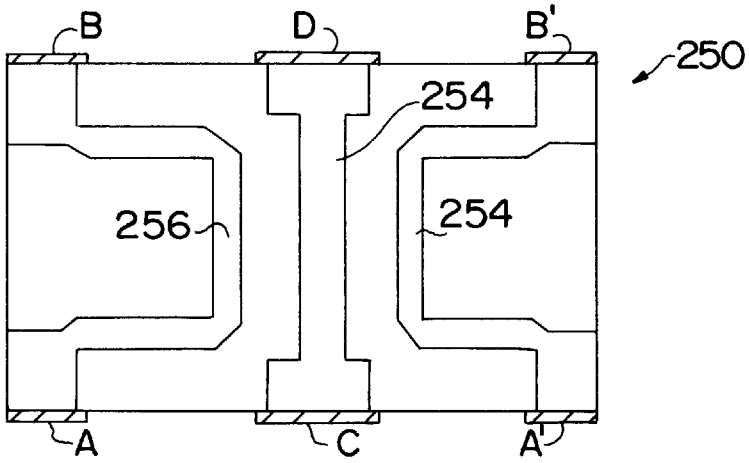
FIG. 22 is a view similar to FIG. 5 of an alternative dual-mode coupler device.

In accordance with the present invention, devices can also be provided that incorporate more than one coupler in one body. For example, FIG. 22 illustrates a dual-mode coupler device 250 that can be utilized to sample, for example, signals at two different frequencies. Toward this end, coupler device 250 includes six terminations (designated A-F). As can be seen, a secondary conductor 252 extends between terminations C and D. Dual primary conductors 254 and 256 extend between termination pairs A-B and A'-B', respectively.

It can be seen that the present invention provides various novel coupler structures adapted for use as surface mount components. While preferred embodiments of the invention have been shown and described, modifications and variations may be made thereto by those of ordinary skill in the art. For example, primary and secondary conductors could be located in entirely in different polymer layers. While the primary conductor has been described above in the lower layer of multilayer embodiments, the primary conductor could be located in an upper layer. In addition, respective polymer layers may be separated by an intermediate polymer layer, with interconnection through a via.

Accordingly, it should be understood that these and other variations of the disclosed embodiments are intended to be included within the scope of the appended claims. In addition, aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A surface mount coupler device comprising a device body having at least four electrical terminations located thereon, said device body including:

an insulating substrate having a top surface and a bottom surface;

a first insulative layer disposed on said top surface of said substrate and being formed of an insulative polymeric material, said first insulative layer defining first and second conductor channels therein;

a first conductor situated in and substantially filling said first conductor channel, said first conductor electrically connected to first and second terminations on said device body;

a second conductor situated in and substantially filling said second conductor channel, said second conductor being electrically connected to at least a third termination on said device body; and an insulating cover layer disposed above said first insulative layer.

2. A surface mount coupler device as set forth in claim 1, wherein said second conductor is electrically connected to third and fourth terminations on said device body.

3. A surface mount coupler device as set forth in claim 2, wherein said device body has at least six terminations thereon, and said first insulative layer further defining a third conductor channel having a conductor therein electrically connected to fifth and sixth terminations on said device body.

4. A surface mount coupler device as set forth in claim 2, wherein said first conductor and said second conductor include respective first and second elongate portions, said first and second elongate portions being situated in parallel to one another and separated by a predetermined spacing.

5. A surface mount coupler device as set forth in claim 4, wherein said first and second elongate portions are substantially straight.

6. A surface mount coupler device as set forth in claim 4, wherein said first and second elongate portions are V-shaped.

7. A surface mount coupler device as set forth in claim 1, wherein said insulative polymeric material is a photoimagable polyimide.

8. A surface mount coupler device as set forth in claim 1, wherein said at least four terminations are located on sides of said device body.

9. A surface mount coupler device as set forth in claim 8, wherein said device body defines opposed side faces and opposed end faces.

10. A surface mount coupler device as set forth in claim 9, wherein said two of said four terminations are located on each of said opposed side faces.

11. A surface mount coupler device as set forth in claim 1, further comprising a third conductor located directly above said first insulative layer, said third conductor being electrically connected to one of said first conductor or said second conductor.

12. A surface mount coupler device as set forth in claim 11, wherein said third conductor is electrically connected to a fourth termination on said device body.

13. A surface mount coupler device as set forth in claim 11, wherein at least one of said conductor channels defined in said first insulative layer is discontinuous to define at least one crossing bridge for said third conductor.

14. A surface mount coupler device as set forth in claim 13, comprising a thin conductive element extending under said crossing bridge.

15. A surface mount coupler device as set forth in claim 12, wherein said first conductor is U-shaped.

16. A surface mount coupler device as set forth in claim 15, wherein said second conductor and said third conductor form a spiral.

* * * * *